US010041267B1

(12) United States Patent
Stevig et al.

(10) Patent No.: US 10,041,267 B1
(45) Date of Patent: Aug. 7, 2018

(54) SEISMIC DAMPING SYSTEMS AND METHODS

(71) Applicant: STATE FARM MUTUAL AUTOMOBILE INSURANCE COMPANY, Bloomington, IL (US)

(72) Inventors: Larry Stevig, Bloomington, IL (US); Brandon Ross Richard, Las Vegas, NV (US)

(73) Assignee: STATE FARM MUTUAL AUTOMOBILE INSURANCE COMPANY, Bloomington, IL (US)

( * ) Notice: Subject to any disclaimer, the term of this patent is extended or adjusted under 35 U.S.C. 154(b) by 0 days.

(21) Appl. No.: 15/256,132

(22) Filed: Sep. 2, 2016

(51) Int. Cl.
*E04H 9/02* (2006.01)
*E04B 1/98* (2006.01)

(52) U.S. Cl.
CPC ..... *E04H 9/022* (2013.01); *E04B 1/985* (2013.01)

(58) Field of Classification Search
CPC ..... E04H 9/022; E04H 9/021; E04H 9/02; E04B 1/985; E04B 1/98
USPC ..... 52/167.8, 167.4, 167.7, 167.9
See application file for complete search history.

(56) References Cited

U.S. PATENT DOCUMENTS 3,852,931 A * 12/1974 Morse ..... E02D 31/08 52/167.1
3,856,242 A * 12/1974 Cook ..... F16F 15/06 248/548
4,697,398 A * 10/1987 Granieri ..... E04B 1/046 52/236.8
4,727,695 A * 3/1988 Kemeny ..... E04H 9/022 14/73.5
4,942,703 A * 7/1990 Nicolai ..... E04H 9/021 248/609
5,014,474 A * 5/1991 Fyfe ..... E04H 9/022 14/73.5
5,452,548 A * 9/1995 Kwon ..... E01D 19/041 248/567

(Continued)

FOREIGN PATENT DOCUMENTS

JP 2007138678 A * 6/2007

OTHER PUBLICATIONS

Machine translation of foreign reference JP2007-138678A, obtained from https://www4.j-platpat.inpit.go.jp/cgi-bin/tran_web_cgi_ejje?u=http://www4.j-platpat.inpit.go.jp/eng/translation/201804050501521242126696960599929E-2B512429AB598CBA3D297E8E35452 (last accessed on Apr. 4, 2018) (Year: 2018).*

(Continued)

*Primary Examiner* — Theodore V Adamos
(74) *Attorney, Agent, or Firm* — Marshall, Gerstein & Borun LLP; Randall G. Rueth

(57) ABSTRACT

A system for damping seismic motions transmitted from a foundation to an architectural structure is disclosed. The system may include a stacked formation of elements including a washer, a sliding plate, and a damping member. The sliding plate may be fixedly connected to a base member of the architectural structure. During seismic motions, the washer may slide over the top of the sliding plate and the damping member may elastically deform. Accordingly, movement of the base member may trail movement of the foundation, and the acceleration experienced by the architectural structure may be reduced. A method of installing such a seismic damping system is also disclosed.

20 Claims, 4 Drawing Sheets

(56) References Cited

U.S. PATENT DOCUMENTS 5,761,856 A * 6/1998 Kishizono ..... E04H 9/022 52/167.7
5,810,177 A * 9/1998 Cabiran ..... B25H 3/04 211/70.6
6,385,918 B1 * 5/2002 Robinson ..... F16F 1/40 267/140.2
6,460,297 B1 * 10/2002 Bonds ..... E04B 1/08 52/234
6,752,389 B2 * 6/2004 Halladay ..... F16F 13/04 267/134
7,070,157 B2 * 7/2006 Huprikar ..... F16F 1/37 248/560
7,249,442 B2 * 7/2007 Pellegrino ..... A47F 5/0018 248/564
7,263,806 B2 * 9/2007 Pellegrino ..... A47B 47/021 248/564
7,856,763 B2 * 12/2010 Keys ..... E04B 7/045 403/232.1
2001/0002529 A1 * 6/2001 Commins ..... E04B 1/26 52/481.1
2004/0216398 A1 * 11/2004 Manos ..... E04B 9/18 52/167.1
2006/0137264 A1 * 6/2006 Shizuku ..... E04H 9/022 52/167.7
2006/0156657 A1 * 7/2006 Commins ..... E04B 1/2604 52/223.13
2006/0254997 A1 * 11/2006 Pellegrino ..... A47B 47/021 211/195
2007/0283635 A1 * 12/2007 Lee ..... E04H 9/022 52/167.7
2008/0092460 A1 * 4/2008 Hilmy ..... E04H 9/02 52/167.8
2008/0222975 A1 * 9/2008 Nakata ..... E04H 9/022 52/167.9
2009/0313917 A1 * 12/2009 Takenoshita ..... E04H 9/022 52/167.7
2015/0076755 A1 * 3/2015 Tait ..... F16F 1/366 267/141

OTHER PUBLICATIONS

Roussis, Panayiotis C. and Constantinou, Michael C. "Experimental and Analytical Studies of Structures Seismically Isolated with an Uplift-Restraint Isolation System." Technical Report MCEER-05-0001. Multidisciplinary Center for Earthquake Engineering Research. University at Buffalo, State University of New York. Published Jan. 10, 2005. pp. i-144.

Marin-Artieda, Claudia C. and Whittaker, Andrew S. "Experimental and Analytical Study of the XY-Friction Pendulum (XY-FP) Bearing for Bridge Applications." Technical Report MCEER-07-2009. Multidisciplinary Center for Earthquake Engineering Research. University at Buffalo, State University of New York. Published Jun. 7, 2007. pp. i-260.

* cited by examiner

SEISMIC DAMPING SYSTEMS AND METHODS

FIELD OF THE DISCLOSURE

The present disclosure generally relates to systems and methods for protecting a structure from seismic activity, and more particularly, to systems and methods for damping seismic motion transmitted from a foundation to an architectural structure.

BACKGROUND OF THE DISCLOSURE

Architectural structures, such as office buildings, retail stores, churches, governmental facilities, warehouses, hospitals, apartments, houses etc., built in earthquake-prone areas sometimes are constructed with a base isolation system. During an earthquake or other sudden ground motion, an architectural structure without a base isolation system may accelerate very quickly. This acceleration, combined with the weight of the architectural structure, can lead to substantial, and potentially damaging, inertial forces in the supporting members of the architectural structure.

Base isolations systems help protect against earthquake damage by reducing the amount of horizontal acceleration experienced by the architectural structure. In general, base isolation systems operate by converting kinetic energy associated with the shock of the earthquake into another form of energy, usually heat, which is then dissipated. The base isolation system, in effect, de-couples movement of the foundation from movement of the architectural structure. Though the architectural structure will still move during the earthquake, the architectural structure will accelerate at a slower rate than the foundation, because of the energy dissipated by the base isolation system. Accordingly, the architectural structure may experience less severe inertial forces as a result of the base isolation system.

Conventional base isolation systems tend to be very complex and/or require specialized installation techniques. Furthermore, base members of the architectural structure may require modification to accommodate a conventional base isolation system. Consequently, conventional base isolation systems tend to be costly and therefore limited to high value structures such as skyscrapers, hospitals, laboratories, bridges, elevated roadways, and the like. Lower value structures, such as residential buildings, usually are not installed with a base isolation system, because their lower value does not justify the expense and time of installing a base isolation system.

Another issue with conventional base isolation systems is that they usually incorporate a horizontal rolling element positioned between the foundation and the architectural structure. Therefore, they may be unable to provide the architectural structure with the vertical restraint needed to resist wind uplift forces and/or overturning forces due to lateral loading from wind or earthquakes. The lack of uplift restraint can render an architectural structure susceptible to damage from upward vertical forces, which have the potential to move the structure off its foundation.

The present disclosure sets forth seismic damping systems and methods embodying advantageous alternatives to existing seismic damping systems, and that may address one or more of the challenges or needs described herein.

SUMMARY

One aspect of the present disclosure provides a system for damping seismic motions transmitted from a foundation to an architectural structure via a base member. The system may include a washer, a sliding plate, and a damping member. The washer may include a washer upper surface, a washer lower surface, and a washer opening extending between the washer upper surface and the washer lower surface. The sliding plate may be configured to be fixedly connected to the base member. The sliding plate may include a sliding plate upper surface, a sliding plate lower surface, and a sliding plate opening extending between the sliding plate upper surface and the sliding plate lower surface. During seismic motions, the sliding plate upper surface may slide against the washer lower surface while the sliding plate lower surface remains fixed relative to an upper surface of the base member. The damping member may be configured to be compressed between the base member and the foundation. Furthermore, the damping member may include a damping member upper surface, a damping member lower surface, and a damping member opening extending between the damping member upper surface and the damping member lower surface. During seismic motions, the damping member may elastically deform to allow the foundation to move horizontally relative to the base member.

Another aspect of the present disclosure provides an architectural structure supported by a foundation. The architectural structure may include a frame, a base member configured to transfer weight of the frame to the foundation, a system for damping seismic motions transmitted from the foundation to the frame via the base member, and an anchoring member. The base member may include a base member upper surface, a base member lower surface, and a base member opening extending between the base member upper surface and the base member lower surface. The system for damping seismic motions may include a washer, a sliding plate fixedly connected to the upper surface of the base member, and a damping member compressed between the base member and the foundation. The washer may include a washer upper surface, a washer lower surface, and a washer opening extending between the washer upper surface and the washer lower surface. The sliding plate may include a sliding plate upper surface, a sliding plate lower surface, and a sliding plate opening extending between the sliding plate upper surface and the sliding plate lower surface. During seismic motions, the sliding plate upper surface may slide against the washer lower surface while the sliding plate lower surface remains fixed relative to the upper surface of the base member. The damping member may include a damping member upper surface, a damping member lower surface, and a damping member opening extending between the damping member upper surface and the damping member lower surface. During seismic motions, the damping member may elastically deform to allow the foundation to move horizontally relative to the base member. The anchoring member may extend vertically through the washer opening, the sliding plate opening, the base member opening, and the damping member opening. Furthermore, the anchoring member may be configured to anchor the base member to the foundation.

Yet another aspect of the present disclosure provides a method of installing a seismic damping system for an architectural structure with a frame supported by at least one base member. The method may include: (a) fixedly connecting the bottom plate to a foundation beneath the architectural structure; (b) fixedly connecting an intermediate plate to a lower surface of the base member; (c) fixedly connecting a sliding plate to an upper surface of the base member; (d) disposing a damping member on top of the bottom plate; (e) disposing the intermediate plate on top of the damping member; (f) disposing a washer on top of the sliding plate; (g) inserting a bolt through an opening in each of the washer, the sliding plate, the base member, the intermediate plate, the damping member, and the bottom plate; and (h) threadably advancing a nut along the bolt to tighten the nut against the washer, thereby compressing the washer, the sliding plate, the base member, the intermediate plate, the damping member, and the bottom plate against the foundation.

BRIEF DESCRIPTION OF THE DRAWINGS

It is believed that the disclosure will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. Also, none of the drawings are necessarily to scale.

DETAILED DESCRIPTION

Figure 1:
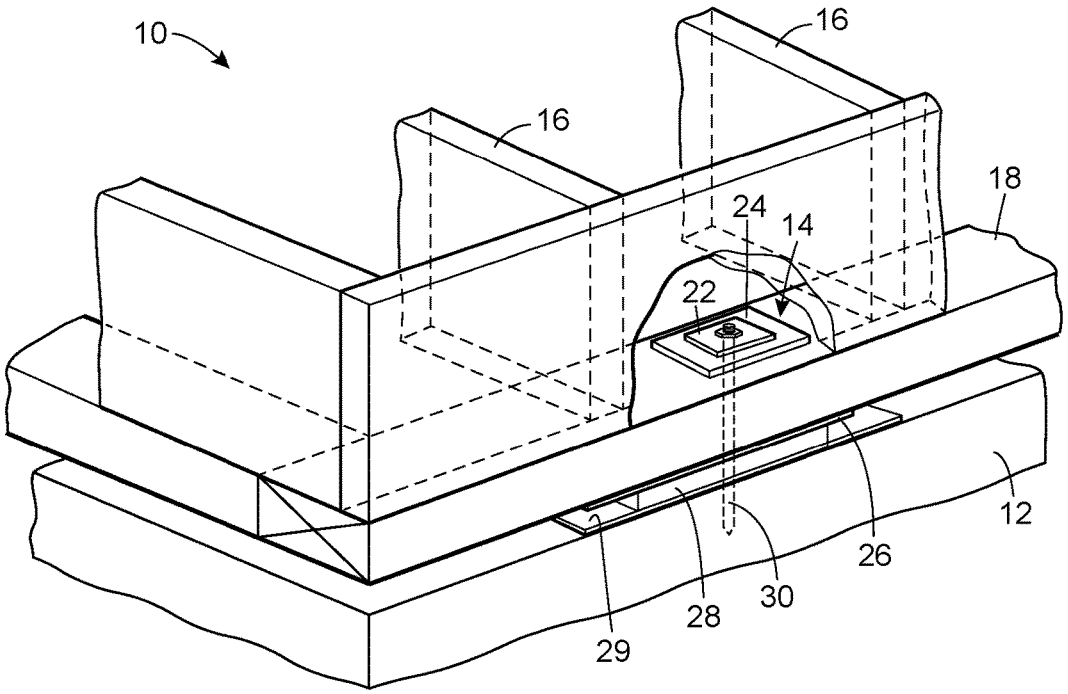
FIG. 1 is a schematic illustration of an architectural structure installed with an embodiment of a seismic damping system according to principles of the present disclosure.

FIG. 1 is a schematic illustration of an architectural structure 10 supported by a foundation 12 and installed with a seismic damping system 14 in accordance with principles of the present disclosure. The architectural structure 10 includes framing 16 (also referred to as a "frame") whose weight is transferred to the foundation 12 via at least one base member 18. The seismic damping system 14 includes a stacked formation of planar, plate-like members including a washer 22, a sliding plate 24, an intermediate plate 26, a damping member 28, and a bottom plate 29, arranged from top to bottom. An anchoring member 30 may secure the base member 18 and the seismic damping system 14 to the foundation 12.

Generally, during a seismic event such as an earthquake or other sudden ground motion, the foundation 12 will move back-and-forth quickly with the ground motion in a horizontal direction, perpendicular to a longitudinal axis A of the anchoring member 30. The foundation 12 may also experience vertical motion, parallel to the longitudinal axis A, though likely of a smaller amplitude than the horizontal motion. The horizontal and/or vertical movement of the foundation 12 may cause the damping member 28 to elastically deform, thereby converting a portion of the kinetic energy released by the seismic event into heat. As a result of the elastic deformation of the damping member 28, movement of the architectural structure 10 may trail movement of the foundation 12, and the acceleration experienced by the architectural structure 10 may be of a lesser magnitude than that experienced by the foundation 12. Accordingly, the inertial forces experienced by the architectural structure 10 may be reduced or dampened, which makes it less likely that the architectural structure 10 is damaged by the seismic motions. So configured, the seismic damping system 14 advantageously provides a relatively simple and low cost approach to protecting an architectural structure from sudden ground motions, without compromising uplift restraint.

Each of the foregoing components of the seismic damping system 14, and methods of installing the seismic damping system 14, will now be described in more detail.

Referring still to FIG. 1, the architectural structure 10 may be a residential structure, such as a single family home, and the framing 16 and/or the base member 18 may be constructed of wood (e.g., sawn lumber, engineered wood products, etc.), metal (e.g., cold-formed steel, metal studs, metal joists, etc.), masonary, or any other suitable material for residential or light-frame construction. In some embodiments, the framing 16 and/or the base member 18 may have a rectangular cross-section with nominal dimensions of two inches by four inches (colloquially referred to as a "two-by-four"), or with nominal dimensions of two inches by six inches, or with nominal dimensions of two inches by eight inches, or with nominal dimensions of two inches by ten inches. The foundation 12 may be buried, completely or partially, in the ground, and may be made of concrete, masonry, or any other material having a load capacity capable of supporting the architectural structure 10.

The architectural structure 10 illustrated in FIG. 1 is representative of a single-family residential structure having wooden structural framing. However, the base isolation systems of the present disclosure are not limited to single-family residential structures and may be installed in any stationary light-frame structure including, but not limited to, a commercial building, multi-family residential building, or even a single room or floor of a building, or a piece of large machinery or equipment.

Figure 2:
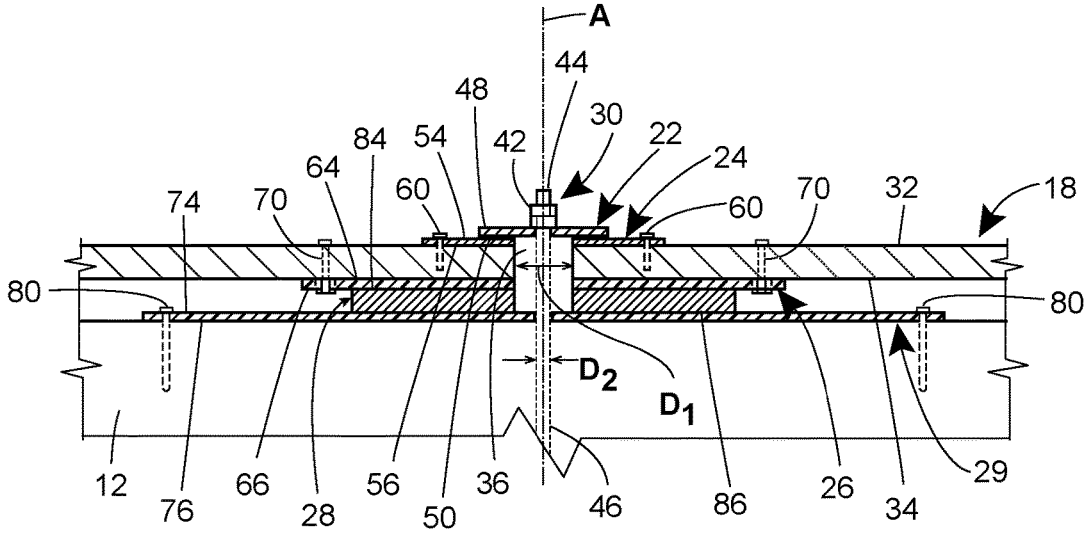
FIG. 2 is a cross-sectional view of the seismic damping system illustrated in FIG. 1.

The base member 18 may extend horizontally and may be disposed between the framing 16 and the foundation 12 such that the base member 18 transfers the weight of the framing 16, and the rest of the architectural structure 10, to the foundation 12. As used herein, the term "horizontal" refers to any direction that is non-parallel to the direction of the earth's gravity at the surface of the earth including, but not limited to, any direction that is perpendicular to the direction of the earth's gravity at the surface of the earth. As used herein, the term "vertical" refers to any direction that is parallel to the direction of earth's gravity at the surface of the earth. In at least one embodiment, the base member 18 may function as a sill plate. As shown in FIG. 2, the base member 18 may include a planar upper surface 32 and a planar lower surface 34 which are parallel to each other. The planar upper surface 32 may face in an upward vertical direction toward the frame 16, and the planar lower surface 34 may face in a downward vertical direction toward the foundation 12. A circular opening 36 may extend through the base member 18 between the planar upper surface 32 and the planar lower surface 34, thereby allowing the anchoring member 30 to pass through the base member 18 and creating an ocular space allowing horizontal movement without contacting the anchoring member 30. The opening 36 may have a diameter D1 which is larger than a diameter D2 of the anchoring member 30. In some embodiments, the base member 30 may include a plurality of openings similar to the opening 36, such that the base member 18 can be secured to the foundation 12 by a plurality of anchoring members each installed with a respective seismic damping system constructed in accordance with principles of the present disclosure.

Referring to FIG. 2, the anchoring member 30 may include a bolt 38 and a nut 42. The bolt 38 may extend along a longitudinal axis A and have a circular cross-section with a diameter D2. An upper end 44 of the bolt 38 may have a threaded exterior surface, and a lower end 46 of the bolt 38 may be configured to be embedded in and/or penetrate the foundation 12. In some embodiments, the tip of the lower end 46 of the bolt 38 may form a right angle or hooked bend, or may use a plate and nut, to prevent the bolt 38 from being removed from the foundation 12. The nut 42 may have a threaded interior surface which threadably engages the upper end 44 of the bolt 38. As described below in more detail, the nut 42 may be threadably advanced along the upper end 44 of the bolt 38, thereby compressing the washer 22 against the sliding plate 24.

By clamping the base member 18 to the foundation 12 and thereby inhibiting upward vertical movement of the base member 18 relative to the foundation 12, the anchoring member 30 is able to provide the architectural structure 10 with uplift restraint. Because the damping system 14 accommodates the anchoring member 30, the damping system 14 does not compromise uplift restraint.

Figure 3:
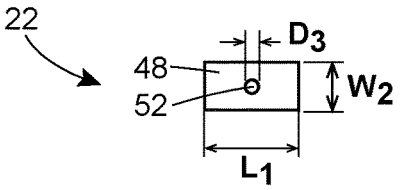
FIG. 3 is a top view of the washer of the seismic damping system of FIG. 2.

FIGS. 2 and 3 illustrate that the washer 22 may be a relatively thin plate and possess a planar upper surface 48, a planar lower surface 50, and a circular central opening 52 extending between the planar upper surface 48 and the planar lower surface 50. The planar upper surface 48 and the planar lower surface 50 may be parallel to each other, and may be parallel to the horizontal direction when installed. The thickness of the washer 22 may be equal to or greater than approximately (e.g., ±10%) 0.25 inches. When the nut 42 is tightened against the washer 22, the washer 22 may distribute the load of the nut 42 over the sliding plate 24. As described below, the washer 22 may float over the sliding plate 24, such that the washer 22 and the sliding plate 24 can move in a horizontal direction relative to each other during horizontal seismic motions.

As shown in FIG. 3, the washer 22 may have a rectangular shape with a length L1 and a width W1. In some embodiments, the length L1 may be equal to or greater than approximately (e.g., ±10%) 5.5 inches, and the width W1 may be equal to or greater than approximately (e.g., ±10%) 2.75 inches. In an alternative embodiment, the washer 22 may have circular outer perimeter such that the washer 22 is disk-shaped. A diameter D3 of the opening 52 may be equal to or slightly greater than the diameter D2 of the anchoring member 30 such that the opening 52 fits snuggly around the anchoring member 30, with little or no clearance therebetween. Due to the close-fitting arrangement of opening 52 and the anchoring member 30, the washer 22 may move together with anchoring member 30, during horizontal seismic motions. In some embodiments, the diameter D3 may be equal to or greater than approximately (e.g., ±10%) 0.5625 inches. Furthermore, the washer 22 may be made of steel with an adhered laminate defining at least the planar lower surface 50. The laminate defining the planar lower surface 50 may made of a polymer low-friction material (e.g., polytetrafluoroethylene (PTFE)), or any other suitable material.

Figure 4:
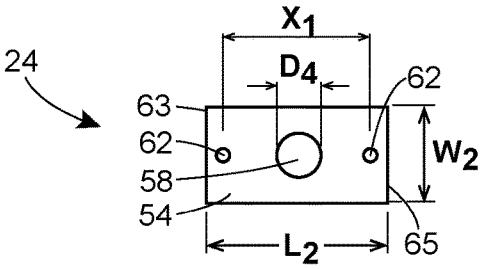
FIG. 4 is a top view of the sliding plate of the seismic damping system of FIG. 2.

Referring to FIGS. 2 and 4, the sliding plate 24 may be a relatively thin plate and possess a planar upper surface 54, a planar lower surface 56, and a circular central opening 58 extending between the planar upper surface 54 and the planar lower surface 56. The planar upper surface 54 and the planar lower surface 56 may be parallel to each other, and may be parallel to the horizontal direction when installed. The thickness of the sliding plate 24 may be equal to or greater than approximately (e.g., ±10%) 0.25 inches. When installed, the planar upper and lower surfaces 54 and 56 of the sliding plate 24 may directly contact, respectively, the planar lower surface 50 of the washer 22 and the planar upper surface of 32 of the base member 18. The sliding plate 24 may be fixedly connected to the base member 18 such that the planer lower surface 56 of the sliding plate 24 remains fixed (i.e., stationary) relative to the upper surface 32 of the base member 18 during seismic motions. As shown in FIG. 2, fasteners 60 (e.g., screws, nails, etc.) may be inserted through fastener openings 62 in the sliding plate 24 and anchored in the base member 18 in order to rigidly secure the sliding plate 24 to the base member 18. By contrast, the planar upper surface 54 of the sliding plate 24 may slidably engage the lower planar surface 50 of the washer 22, such that the washer 22 can float (i.e., slide) over the sliding plate 24 during seismic motions. The diameter D4 of the opening 58 of the sliding plate 24 may be substantially larger than both the diameter D2 of the anchoring member 30 and the diameter D3 of the opening 52 of the washer 22, thereby allowing the anchoring member 30 and the washer 22, at least initially, to move horizontally during the seismic event while the sliding plate 24 remains stationary. In some embodiments the diameter D4 of the opening 58 may be equal to or greater than approximately (e.g., ±10%) 2.75 inches. Furthermore, in some embodiments, the diameter D4 of the opening 58 may be equal to the diameter D1 of the opening 36.

As shown in FIG. 4, the sliding plate 24 may have a rectangular shape possessing a length L2 and a width W2. The footprint or surface area of the sliding plate 24 may be larger than that of the washer 22, thereby providing the washer 22 with sufficient room to slide over top of the sliding plate 24 during horizontal seismic motions. In some embodiments, the length L2 may be equal to or greater than approximately (e.g., ±10%) 10.25 inches, and the width W2 may be equal to or greater than approximately (e.g., ±10%) 5.5 inches. The pair of fastener openings 62 may be separated by a distance X1 that is greater than the length L1 of the washer 22, such that the fasteners 60 can be inserted through their respective fastener openings 62 after the washer 22 has been disposed on top of the sliding plate 24. In some embodiments, the distance X1 may be equal to or greater than approximately (e.g., ±10%) 8.75 inches.

As illustrated in FIG. 2, the sliding plate 24 may be longer than the washer 22 such that a first and a second end 63 and 65 of the sliding plate 24 may extend outwardly of the washer 22 and, as such, may not be covered by the washer 22. The fasteners 60 may extend through the first and second ends 63 and 65 of the sliding plate 24. Also, the fasteners 60 may be positioned beyond the maximum expected horizontal movement of the washer 22 as allowed by the system (depends on diameter D1).

In at least one embodiment, the sliding plate 24 may be constructed of metal (e.g., steel). The material or coating chosen for the sliding plate 24 may provide a coefficient of friction between the sliding plate 24 and the laminate forming the bottom planar surface 50 of the washer 22 that is lower than a coefficient of friction that would exist if the washer 22 and the base member 22 were in direct contact with each other. In this way, the sliding plate 24 facilitates sliding of the washer 22 without wear to the planar upper surface 32 of the base member 18.

Figure 5:
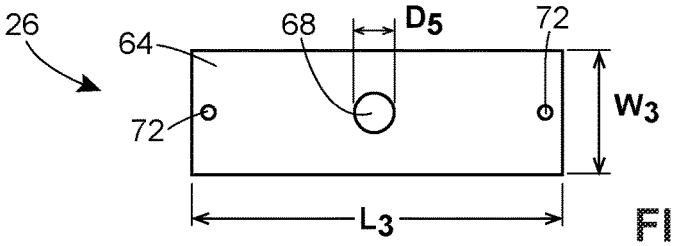
FIG. 5 is a top view of the intermediate plate of the seismic damping system of FIG. 2.

Turning to FIG. 5, the intermediate plate 26 may have a planar upper surface 64, a planar lower surface 66, and a circular central opening 68 extending between the planar upper surface 64 and the planar lower surface 66. The planar upper surface 64 and the planar lower surface 66 may be parallel to each other, and may be parallel to the horizontal direction when installed. The thickness of the intermediate plate 26 may be equal to or greater than approximately (e.g., ±10%) 0.25 inches. When installed, the planar upper and lower surfaces 64 and 66 of the intermediate plate 26 may directly contact, respectively, the planar lower surface 34 of the base member 18 and a planar upper surface of the damping member 28. The intermediate plate 26 may be fixedly connected to the base member 18 such that the planer upper surface 66 of the intermediate plate 26 remains fixed (i.e., stationary) relative to the planar lower surface 34 of the base member 18 during seismic motions. As shown in FIG. 2, fasteners 70 (e.g., screws, bolts, etc.) may be inserted through fastener openings 72 in the intermediate plate 26 and anchored in the base member 18, in order to rigidly secure the intermediate plate 26 to the base member 18. In at least one embodiment, the intermediate plate 26 is made of metal (e.g., steel).

As shown in FIG. 5, the intermediate plate 26 may have a rectangular shape possessing a length L3 and a width W3. In some embodiments, the length L3 may be equal to or greater than approximately (e.g., ±10%) 21.5 inches, and the width W3 may be equal to or greater than approximately (e.g., ±10%) 7.25 inches. The diameter D5 of the opening 68 of the intermediate plate 26 may be substantially larger than the diameter D2 of the anchoring member 30 and the diameter D3 of the opening 52 of the washer 22, thereby allowing the anchoring member 30 and the washer 22, at least initially, to move horizontally during a seismic event while the intermediate plate 26 remains stationary. In some embodiments the diameter D5 of the opening 68 of the intermediate plate 26 may be equal to or greater than approximately (e.g., ±10%) 2.75 inches. Furthermore, the diameter D5 of the opening 68 of the intermediate plate 26 may be equal to the diameter D1 of the opening 36 in the base member 18 and/or the diameter D4 of the opening 58 in the sliding plate 24.

Figure 6:
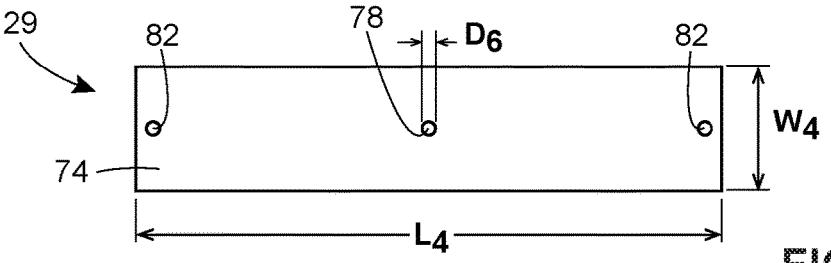
FIG. 6 is a top view of the bottom plate of the seismic damping system of FIG. 2.

FIGS. 2 and 6 illustrate that the bottom plate 29 may have a planar upper surface 74, a planar lower surface 76, and a circular central opening 78 extending between the planar upper surface 74 and the planar lower surface 76. The thickness of the bottom plate 29 may be equal to or greater than approximately (e.g., ±10%) 0.25 inches. When installed, the planar upper and lower surfaces 74 and 76 of the bottom plate 29 may directly contact, respectively, the planar lower surface of the damping member 28 and a planar surface of the foundation 12. The bottom plate 29 may be fixedly connected to the foundation 12 such that the planer lower surface 76 of the bottom plate 29 remains fixed (i.e., stationary) relative to the foundation 12 during seismic motions. Accordingly, the bottom plate 29 may move together with the foundation 12. As shown in FIG. 2, fasteners 80 (e.g., screws, bolts, etc.) may be inserted through fastener openings 82 in the bottom plate 29 and anchored in the foundation 12, in order to rigidly secure the bottom plate 29 to the foundation 12. In at least one embodiment, the bottom plate 26 is made of metal (e.g., steel).

Referring still to FIG. 6, the bottom plate 29 may have a rectangular shape possessing a length L4 and a width W4. In some embodiments, the length L4 may be equal to or greater than approximately (e.g., ±10%) 34.0 inches, and the width W4 may be equal to or greater than approximately (e.g., ±10%) 7.25 inches. The diameter D6 of the opening 78 of the bottom plate 29 may be equal to or slightly greater than the diameter D2 of the anchoring member 30 such that the opening 78 fits snuggly around the anchoring member 30, with little or no clearance therebetween. In some embodiments, the diameter D6 may be equal to or greater than approximately (e.g., ±10%) 0.5625 inches. Furthermore, the diameter D6 of the opening 78 of the bottom plate 29 may be equal to the diameter of the opening 52 of the washer 22. The locations of the fastener openings 82 may be outboard of a perimeter of the intermediate plate 26 to allow installation of the fasteners 80.

Figure 7:
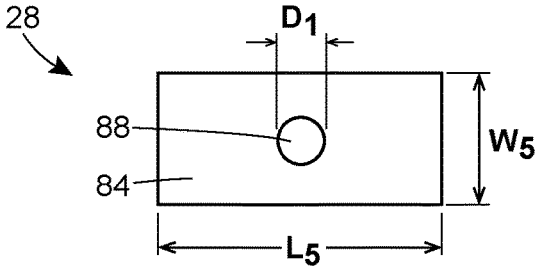
FIG. 7 is a top view of the damping member of the seismic damping system of FIG. 2.

Referring now to FIGS. 2 and 7, the damping member 28 may have a planar upper surface 84, a planar lower surface 86, and a circular central opening 88 extending between the planar upper surface 84 and the planar lower surface 86. The thickness of the damping member 28 may be equal to or greater than approximately (e.g., ±10%) 1.5 inches, or within a range of approximately (e.g., ±10%) 0.5-3.0 inches, or within a range of approximately (e.g., ±10%) 1.0-2.0 inches, or within a range of approximately (e.g., ±10%) 1.2-1.8 inches, or within a range of approximately (e.g., ±10%) 1.4-1.6 inches. When installed (as seen in FIG. 2), the planar upper and lower surfaces 84 and 86 of the damping member 28 may directly contact, respectively, the planar lower surface 66 of the intermediate plate 26 and the planar upper surface 74 of the bottom plate 29. The damping member 28 may be compressed between the intermediate plate 26 and the bottom plate 29 due to the clamping force provided by the anchoring member 30. In some embodiments, the damping member 28 may be fixedly connected to the intermediate plate 26 or the bottom plate 29 with adhesive over all or a portion of each surface.

As illustrated in FIG. 7, the damping member 28 may have a rectangular shape possessing a length L5 and a width W5. In some embodiments, the length L5 may be in a range of approximately (e.g., ±10%) 10.0-30.0 inches, or approximately (e.g., ±10%) 12.0-24.0 inches, or approximately (e.g., ±10%) 14.0-22.0 inches, or approximately (e.g., ±10%) 16.0-20.0 inches, or approximately (e.g., ±10%) 17.0-18.0 inches. In some embodiments, the width W4 may be equal to or greater than approximately (e.g., ±10%) 4.0-7.25 inches. A diameter D7 of the opening 88 of the damping member 28 may be substantially larger than the diameter D2 of the anchoring member 30, the diameter D3 of the opening 52 of the washer 22, and the diameter D6 of the bottom plate 29, thereby allowing the anchoring member 30, the washer 22, and the bottom plate 29 at least initially, to move horizontally during a seismic event while a portion, or the entirety, of the damping member 28 remains stationary. Furthermore, in at least one embodiment, the diameter D7 of the opening 88 of the damping member 28 may be equal to the diameter D1 of the opening 36 in the base member 18, the diameter D4 of the opening 58 in the sliding plate 24, and/or the diameter D5 of the opening 68 of the intermediate plate 26.

In general, the damping member 28 may be constructed, in whole or in part, of a flexible material capable of elastic deformation. During seismic motions, the damping member 28 may elastically deform, thereby converting kinetic energy into heat, such heat being subsequently dissipated into the surroundings. By dissipating some of the kinetic energy released by the seismic event, the damping member 28 may help reduce or dampen the accelerations and/or velocities experienced by the architectural structure 10. Furthermore, because the deformation of the damping member 28 is elastic, after the seismic motions have ceased, the damping member 28 may naturally return to its original shape. Accordingly, the damping member 28 may help re-center the base member 18 and the seismic damping system 14 around the anchoring member 30 after the seismic event has ended. In some embodiments, the damping member 28 may made, in whole or in part, of an elastomer (e.g., rubber, polybutadiene, polyisobutylene, or polyurethane) or a fiber-reinforced elastomer.

While the present embodiment of the seismic damping system is described as including a stack formation of rectangular plates with planar surface, alternative embodiments of the seismic damping system may be configured differently, for example, with stacked formation of circular or polygonal plates with one or more curved or countered surfaces.

Figure 8:
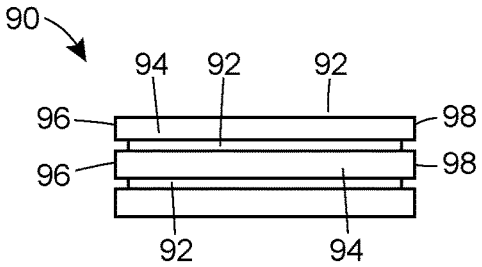
FIG. 8 is a schematic side view of another embodiment of the damping member.

FIG. 8 illustrates an embodiment of a damping member 90 constructed of multiple layers of material. The damping member 90 includes alternatingly arranged reinforcement layers 92 and elastomeric layers 94. The reinforcement layers 92 may be made of metal (e.g., steel) or a fiber-reinforced material, and the elastomeric layers 94 may be made of an elastomer (e.g., rubber, polybutadiene, polyisobutylene, or polyurethane). Each of the reinforcement layers 92 may have a thickness that is less than that of each of the elastomeric layers 94. Also, as illustrated in FIG. 8, each of the elastomeric layers 94 may be longer and/or wider than each of the reinforcement layers 92. When the damping member 90 deforms during seismic motions, the exposed first and second ends 96 and 98 ends of the elastomeric layers 94 may bend or knuckle and contact the planar lower surface 66 of the intermediate plate 26 and/or the planar upper surface 74 of the bottom plate 29. This contact may further help reduce or dampen seismic motions transmitted to the architectural structure 10. In an alternative embodiment, the elastomeric layers 94 and the reinforcement layers 92 may each of the same length and width, so that their edges are flush.

Figure 10:
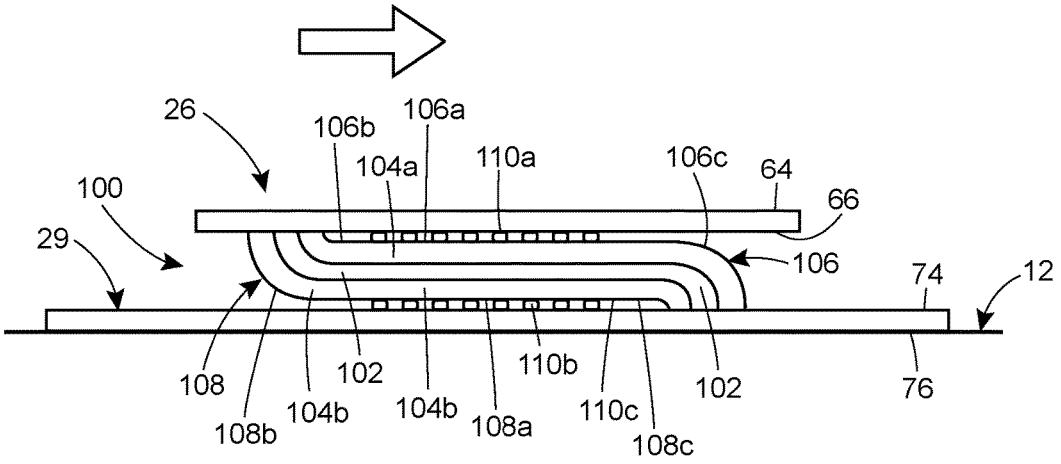
FIG. 10 is a schematic side view of another embodiment of the damping member.

The knuckling effect of the damping member 90 may be accomplished by other means, including by partially adhering the damping member to one or both of the intermediate plate 26 and the bottom plate 29, as shown in FIG. 10. FIG. 10 is a schematic illustration of a damping member 100 arranged between the intermediate plate 26 and the bottom plate 29, where a seismic event has caused the intermediate plate 26 to move horizontally to the right relative to the bottom plate 29. Although not illustrated in FIG. 10, the damping member 100 may be installed as part of a seismic damping system in a similar manner as the damping member 28 illustrated in FIGS. 1 and 2. The damping member 100 is constructed of a reinforcement layer 102 sandwiched between upper and lower elastomeric layers 104*a* and 104*b*. The upper elastomeric layer 104*a* may define an upper surface 106 of the damping member 100, and the lower elastomeric layer 104*b* may define a lower surface 108 of the damping member 100. Similar to the damping member 90, the reinforcement layer 102 may be made of metal (e.g., steel) or a fiber-reinforced material, and the elastomeric layers 104*a* and 104 *b* may be made of an elastomer (e.g., rubber, polybutadiene, polyisobutylene, or polyurethane). Also, in some embodiments, the reinforcement layer 102 may have a thickness which is less than that of each of the elastomeric layers 104*a* and 104*b*.

The upper surface 106 of the damping member 100 includes a middle portion 106*a* and first and second end portions 106*b* and 106*c* arranged on opposite sides of the middle portion 106*a*. Similarly, the lower surface 108 of the damping member 100 includes a middle portion 108*a* and first and second end portions 108*b* and 108*c* arranged on opposite sides of the middle portion 108*a*. The middle portion 106*a* of the upper surface 106 of the damping member 100 may be adhered to the planar lower surface 66 of the intermediate plate 26 by an adhesive 110*a*, whereas the first and second end portions 106*b* and 106*c* of the upper surface 106 of the damping member 100 may not be adhered to the planar lower surface 66 of the intermediate plate 26. Similarly, the middle portion 108*a* of the upper surface 108 of the damping member 100 may be adhered to the planar upper surface 74 of the bottom plate 29 by an adhesive 110*b*, whereas the first and second end portions 108*b* and 108*c* of the lower surface 108 of the damping member 100 may not be adhered to the planar upper surface 74 of the bottom plate 29. As a result, when the damping member 100 deforms during horizontal seismic motions, the first and second end portions 106*b* and 106*c* of the upper surface 106 and the first and second end portions 108*b* and 108*c* of the lower surface 106 may curl either upwards or downwards, depending on the direction of the motion. For instance, as seen in FIG. 10, when the intermediate plate 26 moves horizontally to the right relative to the bottom plate 29, the first end portions 106*b* and 108*b* curl upwards, whereas the second end portions 106*c* and 108*c* curl downwards. Consequently, the exposed ends of the damping member 100 are caused to engage and be dragged along either the planar lower surface 66 of the intermediate plate 26 or the planar upper surface 74 of the bottom plate 29. This action creates friction may help dissipate kinetic energy released by the seismic event as heat.

Figure 9:
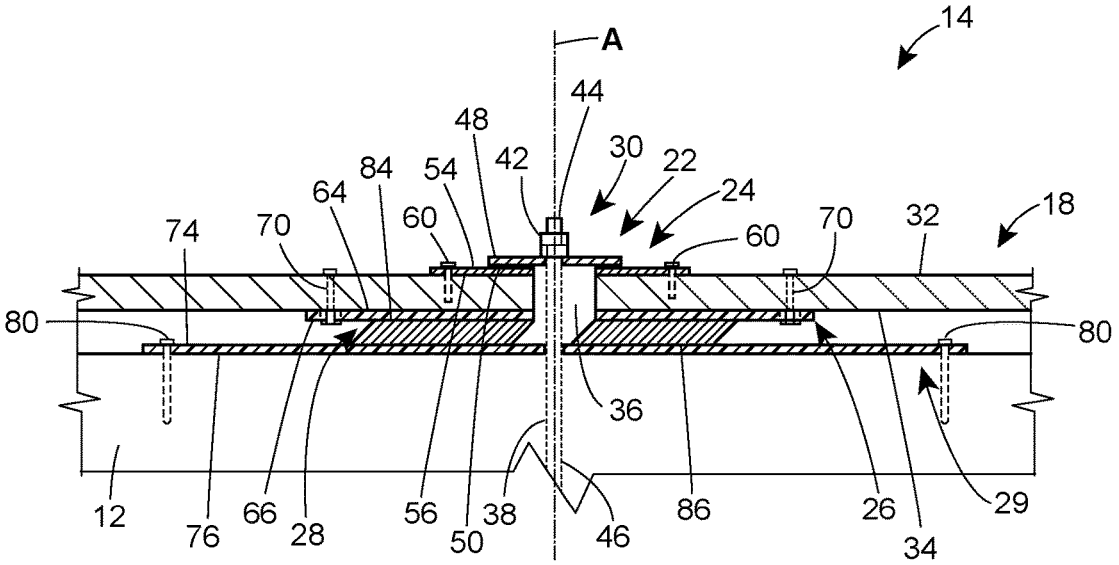
FIG. 9 is a cross-sectional view of the seismic damping system illustrated in FIG. 2 during a seismic event.

The operation of the seismic damping system 14 will now be described with reference to FIGS. 2 and 9. Prior to a seismic event, the centers of the openings in each of the washer 22, the sliding plate 24, the base member 18, the intermediate plate 26, the damping member 28, and the bottom plate 29 may be aligned with each other, as illustrated in FIG. 2. When a seismic motion causes the foundation 12 to shift in the left horizontal direction in FIG. 2, the damping system 14 initially may adopt the configuration illustrated in FIG. 9. Here it is shown that the anchoring member 30, which moves together with the foundation 12, has shifted to the left in the horizontal direction. As a result, the anchoring member 30, which fits snugly through the openings in each of the washer 22 and the bottom plate 29, causes the washer 22 and the bottom plate 29 to move in the left horizontal direction. Initially, the sliding plate 24 may remain stationary because the washer 22 slides over the top of the sliding plate 24. The anchoring member 30 may not move the sliding plate 24 because the diameter D4 of the opening 58 in the sliding plate 24 is much larger than the diameter D2 of the anchoring member 30. Similarly, the base member 18 and the intermediate plate 24 also may remain stationary, because of the diameters D1 and D5 of the openings 36 and 68 are much larger than the diameter D2 of the anchoring member 30. A bottom portion of the damping member 28, due to partial or full bonding with adhesive between the damping member 28 and the bottom plate 29, may move to the left in the horizontal direction with bottom plate 19. However, the upper portion of the damping member 28 initially may remain stationary, due to partial or full bonding with adhesive between the damping member 28 and the intermediate plate 26. As shown in FIG. 9, this causes the damping member 28 to deform so that it has a deformed shape which is different from its original shape (FIG. 2). After a short period of time, the damping member 28 may regain its original shape due to its elasticity. As a result, the upper portion of the damping member 28 may move to the left in the horizontal direction, thereby pulling the intermediate plate 26, the base member 18, and the sliding plate 24 to the left in the horizontal direction. Because a portion of the kinetic energy will have been lost to the elastic deformation of the damping member 28, the acceleration of the base member 18 in the left horizontal direction will be less than that experienced by the foundation 12. This process repeats itself as the foundation moves to the right and back again to the left, and so on, during the seismic event. Accordingly, the architectural structure 10 may experience less drastic horizontal accelerations during the seismic event than if the seismic damping system 14 was not installed. Furthermore, because the anchoring member 30 is able to restrain movement of the base member 18 in the upward vertical direction, the architectural structure 10 is unlikely to be moved off the foundation 12. The limits of the openings also provide "stops" to the ultimate horizontal displacement of the architectural structure 10.

A method of installing the seismic damping system 14 may involve the following steps. As a preliminary step, the bolt 38 may anchored (e.g., casted) in the foundation 12. Next, an assembly is fabricated in a controlled environment, including the bottom plate 29, the damping member 28, and the intermediate plate 26. The bottom plate 29 and the pre-fabricated assembly may be inserted over the bolt 38 and fixedly connected to the foundation 12 by inserting the fasteners 80 through their respective fastener openings 82, thereby anchoring them in the foundation 12. Next, the base member 18 is placed on the planar upper surface 64 of intermediate plate 26 and fixedly connected using fasteners 70. Then, the sliding plate 24 may be fixedly connected to the upper planar surface 32 of the base member 18. This step may be accomplished by disposing the sliding plate 24 against the upper planar surface 32 of the base member 18, and inserting the fasteners 60 through their respective fastener openings 62 in the sliding plate 24 so that they are anchored in the base member 18. Next, the washer 22 may be disposed on top of the sliding plate 24 such that the planar lower surface 50 of the washer 22 contacts the planar upper surface 54 of the sliding plate 24. Finally, the nut 42 may be screwed around the upper end 44 of the bolt 38 so that the nut is threadably advanced along the bolt 38 and tightened against the planar upper surface 48 of the washer 22. In this manner, the base member 18 and the damping member 28 may be compressed between the nut 42 and the foundation 12.

While the invention has been described in connection with various embodiments, it will be understood that the invention is capable of further modifications. This application is intended to cover any variations, uses or adaptations of the invention following, in general, the principles of the invention, and including such departures from the present disclosure as, within the known and customary practice within the art to which the invention pertains.

What is claimed is:

1. A system for damping seismic motions transmitted from a foundation to an architectural structure via a base member, the system comprising:

a washer including a washer upper surface, a washer lower surface, and a washer opening extending between the washer upper surface and the washer lower surface;

a sliding plate configured to be fixedly connected to an upper surface of the base member such that the sliding plate is disposed above the base member, the sliding plate including a sliding plate upper surface, a sliding plate lower surface, a first sliding plate opening extending between the sliding plate upper surface and the sliding plate lower surface, and a second sliding plate opening extending between the sliding plate upper surface and the sliding plate lower surface, wherein, during seismic motions, the sliding plate upper surface slides against the washer lower surface and the sliding plate lower surface remains fixed relative to the upper surface of the base member;

a first fastener configured to extend through the second sliding plate opening and fixedly connect the sliding plate to the base member such that the sliding plate lower surface remains fixed relative to the upper surface of the base member during seismic motions;

a damping member configured to be compressed between the base member and the foundation, the damping member including a damping member upper surface and a damping member lower surface, wherein, during seismic motions, the damping member elastically deforms to allow the foundation to move horizontally relative to the base member; and the damping member having a single, central opening positioned away from an outer periphery of the damping member and configured to permit an uplift restraint member to pass centrally through the damping member.

2. The system of claim 1, comprising:

an intermediate plate configured to be fixedly connected to the base member on a side opposite to the sliding plate, the intermediate plate including an intermediate plate upper surface configured for direct contact with the base member, an intermediate plate lower surface, and an intermediate plate opening extending between the intermediate plate upper surface and the intermediate plate lower surface, wherein an entirety of the damping member is positioned below the intermediate plate;

a bottom plate configured to be fixedly connected to the foundation, the bottom plate including a bottom plate upper surface, a bottom plate lower surface, and a bottom plate opening extending between the bottom plate upper surface and the bottom plate lower surface; and wherein the damping member is configured to be compressed between the intermediate plate lower surface and the bottom plate upper surface.

3. The system of claim 2, wherein an inner diameter of the first sliding plate opening is greater than an inner diameter of the washer opening.

4. The system of claim 3, wherein an inner diameter of the intermediate plate opening is greater than an inner diameter of the bottom plate opening.

5. The system of claim 4, wherein the inner diameter of the bottom plate opening and the inner diameter of the washer opening are equal to each other.

6. The system of claim 2, the damping member upper surface including a middle portion and first and second end portions located on opposite sides of the middle portion, wherein an adhesive covers the middle portion of the upper surface of the damping member to adhere the damping member to the intermediate plate, and wherein the first and second end portions of the upper surface of the damping member are free of the adhesive.

7. The system of claim 1, wherein the damping member upper surface and the damping member lower surface are each planar and parallel to each other when not deformed by seismic motions.

8. The system of claim 7, the damping member including a layer of reinforcement material sandwiched between two layers of elastomeric material, wherein the layer of reinforcement material is thinner than each of the two layers of elastomeric material.

9. The system of claim 1, the sliding plate being longer than the washer such that a first and a second end of the sliding plate extend outwardly from opposite sides of the washer, the second sliding plate opening being formed in the first end of the sliding plate, and a third sliding plate opening being formed in the second end of the sliding plate.

10. The system of claim 9, comprising a second fastener configured to extend through the third sliding plate opening and fixedly connect the sliding plate to the upper surface of the base member.

11. An architectural structure supported by a foundation, the architectural structure comprising:

a frame;

a base member configured to transfer weight of the frame to the foundation, the base member including a base member upper surface, a base member lower surface, and a base member opening extending between the base member upper surface and the base member lower surface;

a system for damping seismic motions transmitted from the foundation to the frame via the base member, the system including a washer including a washer upper surface, a washer lower surface, and a washer opening extending between the washer upper surface and the washer lower surface, a sliding plate fixedly connected to the upper surface of the base member such that the sliding plate is disposed above the base member, the sliding plate including a sliding plate upper surface, a sliding plate lower surface, a first sliding plate opening extending between the sliding plate upper surface and the sliding plate lower surface, and a second sliding plate opening extending between the sliding plate upper surface and the sliding plate lower surface, wherein, during seismic motions, the sliding plate upper surface slides against the washer lower surface and the sliding plate lower surface remains fixed relative to the upper surface of the base member, a fastener extending through the second sliding plate opening and fixedly connecting the sliding plate to the base member such that the sliding plate lower surface remains fixed relative to the upper surface of the base member during seismic motions, a damping member compressed between the base member and the foundation, the damping member including a damping member upper surface and a damping member lower surface, wherein, during seismic motions, the damping member elastically deforms to allow the foundation to move horizontally relative to the base member, and the damping member having a single, central opening positioned away from an outer periphery of the damping member; and an anchoring member extending vertically through the washer opening, the first sliding plate opening, the base member opening, and the central opening of the damping member, the anchoring member being configured to anchor the base member to the foundation in resistance to vertical uplift forces.

12. The architectural structure of claim 11, the system for damping seismic motions including:

an intermediate plate including an intermediate plate upper surface, an intermediate plate lower surface, and an intermediate plate opening extending between the intermediate plate upper surface and the intermediate plate lower surface, the intermediate plate upper surface directly contacting and being fixedly connected to the lower surface of the base member;

a bottom plate fixedly connected to the foundation, the bottom plate including a bottom plate upper surface, a bottom plate lower surface, and a bottom plate opening extending between the bottom plate upper surface and the bottom plate lower surface, and wherein the damping member is positioned between the intermediate plate and the bottom plate, and wherein the anchoring member passes through the intermediate plate opening and the bottom plate opening.

13. The architectural structure of claim 12, an inner diameter of the first sliding plate opening being greater than an inner diameter of the washer opening;

an inner diameter of the intermediate plate opening being greater than an inner diameter of the bottom plate opening; and the inner diameter of the bottom plate opening and the inner diameter of the washer opening being equal to each other.

14. The architectural structure of claim 13, the anchoring member including:

a bolt having a bolt upper end and a bolt lower end, the bolt lower end passing through the washer opening, the first sliding plate opening, the base member opening, and the central opening of the damping member; and a nut threadably engaging the bolt upper end and configured to compress the washer against the sliding plate.

15. The architectural structure of claim 11, wherein the damping member upper surface and the damping member lower surface are each planar and parallel to each other.

16. The architectural structure of claim 11, the damping member including a layer of reinforcement material sandwiched between two layers of elastomeric material, wherein the layer of reinforcement material is thinner than each of the two layers of elastomeric material.

17. A method of installing a seismic damping system for an architectural structure with a frame supported by at least one base member, the method comprising:

fixedly connecting a bottom plate to a foundation beneath the architectural structure;

fixedly connecting an intermediate plate to a lower surface of the base member;

fixedly connecting a sliding plate to an upper surface of the base member by inserting a first fastener through a first opening in the sliding plate;

disposing a damping member on top of the bottom plate, the damping member having a single, central opening positioned away from an outer periphery of the damping member;

disposing the intermediate plate on top of the damping member;

disposing a washer on top of the sliding plate;

inserting a bolt through an opening in the washer, a second opening in the sliding plate, an opening in the base member, an opening in the intermediate plate, the central opening in the damping member, and an opening in the bottom plate; and threadably advancing a nut along the bolt to tighten the nut against the washer, thereby holding the washer, the sliding plate, the base member, the intermediate plate, the damping member, and the bottom plate against the foundation.

18. The method of claim 17, the damping member including a planar upper surface and a planar lower surface, and the opening in the damping member extending between the planar upper surface and the planar lower surface.

19. The method of claim 17, wherein the second opening of the sliding plate possesses a larger inner diameter than the opening of the washer.

20. The method of claim 19, wherein the opening of the intermediate plate possesses a larger inner diameter than the opening of the bottom plate.

* * * * *